US006659925B2

(12) United States Patent
Wideman et al.

(10) Patent No.: US 6,659,925 B2
(45) Date of Patent: Dec. 9, 2003

(54) STRETCHING MACHINE

(76) Inventors: R. Leon Wideman, 1650 Neff Rd., St. Clair, MO (US) 63077; Ryan L. Wideman, 7885 Oaklawn Pl., Cedar Hill, MO (US) 63016

( * ) Notice: Subject to any disclaimer, the term of this patent is extended or adjusted under 35 U.S.C. 154(b) by 43 days.

(21) Appl. No.: 10/037,868

(22) Filed: Oct. 23, 2001

(65) Prior Publication Data

US 2003/0078146 A1 Apr. 24, 2003

(51) Int. Cl.[7] ..... A63B 71/00

(52) U.S. Cl. ..... 482/148; 482/131; 482/907; 482/908

(58) Field of Search ..... 482/131, 907, 482/908

(56) References Cited

U.S. PATENT DOCUMENTS

| | | | | |
|---|---|---|---|---|
| 1,376,655 A | | 5/1921 | Stevens | |
| 1,603,521 A | | 10/1926 | Davidson et al. | |
| 2,309,511 A | | 1/1943 | Kellogg | 265/20 |
| 2,590,055 A | | 3/1952 | Timmerman | 73/379 |
| 3,290,985 A | | 12/1966 | Bains et al. | 88/1 |
| 3,364,747 A | | 1/1968 | Ebstein | 73/379 |
| 3,504,540 A | | 4/1970 | Pradko et al. | 73/141 |
| 4,463,946 A | | 8/1984 | Wallace et al. | 272/111 |
| 4,877,239 A | | 10/1989 | Dela Rosa | 272/126 |
| 5,004,228 A | | 4/1991 | Powers | 272/125 |
| 5,149,313 A | | 9/1992 | Jones | 482/100 |
| 5,211,562 A | | 5/1993 | Wickstrom | 434/260 |
| 5,421,801 A | * | 6/1995 | Davies | 482/131 |
| 5,538,487 A | | 7/1996 | Fulmer | 482/42 |
| 5,567,202 A | | 10/1996 | Hager | 482/131 |
| 5,755,576 A | | 5/1998 | Dunn et al. | 434/258 |
| 5,842,960 A | | 12/1998 | Yu | 482/131 |
| 5,938,573 A | | 8/1999 | Davies, III et al. | 482/131 |
| 6,149,550 A | | 11/2000 | Shteingold | 482/8 |
| 6,203,473 B1 | | 3/2001 | Atwood | 482/95 |

* cited by examiner

*Primary Examiner*—Nicholas D. Lucchesi
*Assistant Examiner*—L Amerson
(74) *Attorney, Agent, or Firm*—Gregory E. Upchurch

(57) ABSTRACT

A stretching machine is provided which can be used both for stretching and for measuring a level of flexibility. The machine rests on the floor and a beam is adjusted to a convenient height. The beam is provided with a plurality of handgrips. A foot plate is positioned to abut a user's feet. By leaning forward and grasping the handgrips a person can stretch their legs and lower back as well as determine a level of flexibility by noting which handgrip is grasped. The machine has a cutout on the foot plate to allow compact storage.

14 Claims, 4 Drawing Sheets

STRETCHING MACHINE

BACKGROUND OF THE INVENTION

The invention is drawn generally to an exercise device. The invention is a machine operated by a user for the purpose of facilitating the conditioning of a muscle of the user by progressive stretching and repetitive activity of the user. Specifically, the invention is drawn to a machine which enables a user to lengthen or extend the muscles of the user's legs and lower back. Additionally, the machine gives an indication of the flexibility of the user.

A vital component of a comprehensive fitness program is flexibility. Many athletic injuries could be avoided by proper stretching. The legs and lower back are two of the most important areas of the body to stretch. The most common stretch is to reach for one's toes. This stretch can be performed either standing up or sitting down. A shortcoming of this stretch is that it is difficult to tell how far a person can reach. One approach to resolving this shortcoming is to place a scale on the outside of a box. Referring to FIGS. 2*a,* 2*b* and 2*c,* it can be seen how a user places his feet inside the box and leans as far forward as possible. By noting where the user's hands are on the scale of the box a degree of flexibility can be determined. This prior art box fails to take into account different sized users and is not adjustable in height. Another problem is the lack of a handgrip to facilitate the stretch by pulling forward. To get consistent readings on flexibility a person's feet must be placed in the same position during each stretch. With the box, the only way to ensure this is to place the feet against the back wall of the box. This eliminates the ability to measure a stretch past the feet.

To solve these problems several inventions have been put forward. U.S. Pat. Nos. 5,421,801 and 5,938,573 are drawn to stretching machines having a bar with a plurality of ladder rung type projections. An indication of flexibility is determined by noting which projections are grasped during the stretch. These patents are drawn to an extensive system requiring a lot of space to use. In addition these devices require a stand and a seat and are quite complex.

U.S. Pat. No. 2,590,055 is an apparatus for measuring muscular strength. U.S. Pat. No. 4,877,239 is a thigh muscle stretching device. U.S. Pat. No. 5,004,228 is a leg stretching apparatus. U.S. Pat. No. 6,203,473 is a stretching and exercise apparatus. U.S. Pat. No. 5,567,202 is a fitness device. These devices allow a person to measure physical fitness or to stretch muscles, but none of the devices do both.

BRIEF SUMMARY OF THE INVENTION

According to the invention a stretching machine is provided which can be used both for stretching and for measuring a level of flexibility. The machine rests on the floor and a user sits adjacent the machine with the user's feet abutting the foot plate. A beam is then adjusted to a convenient height above the user's legs. The beam is provided with a plurality of handgrips. By leaning forward and grasping a handgrip a user can stretch their legs and lower back as well as determine a level of flexibility by noting which handgrip is grasped.

The machine has a cutout on the foot plate which allows the beam to be lowered towards the base plate when not in use. The cutout is large enough to accommodate the beam and handgrips such that the device is reduced in size to the size of the end plate.

The machine has an angled height adjustment member which allows the beam to be extended past the foot plate. This allows a user to measure flexibility past the feet.

BRIEF DESCRIPTION OF THE SEVERAL VIEWS OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE INVENTION

Figure 1:
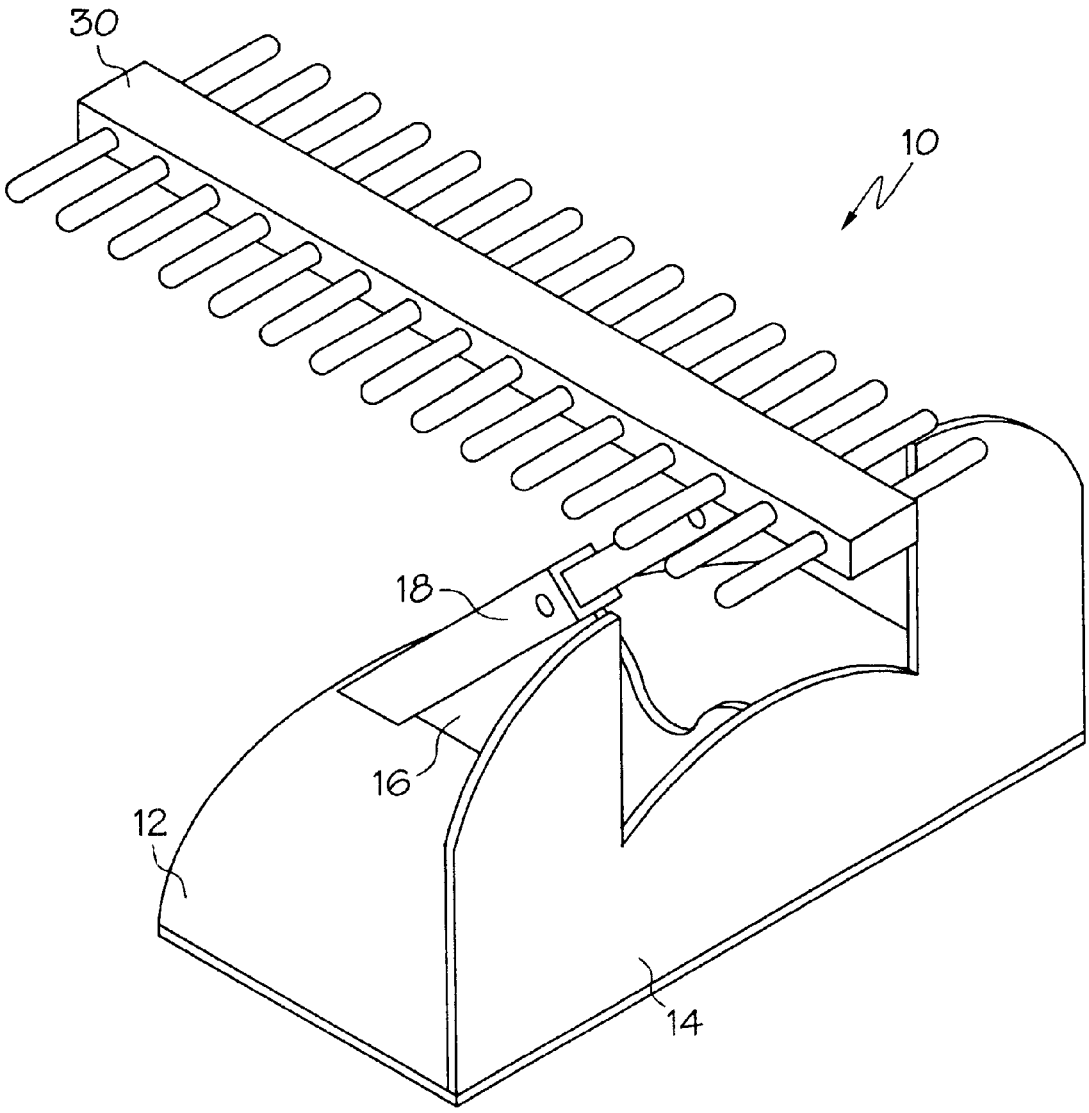
FIG. 1 is a perspective view of the invention.
Figure 2A:
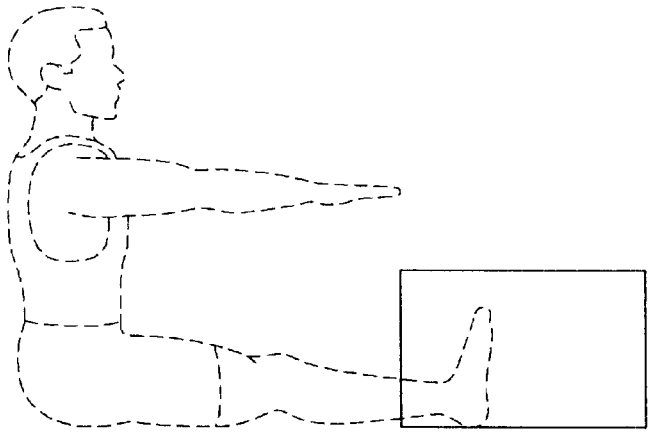
FIG. 2A (PRIOR ART)
FIG. 2*a* is a side view of the prior art at an initial position.
Figure 2B:
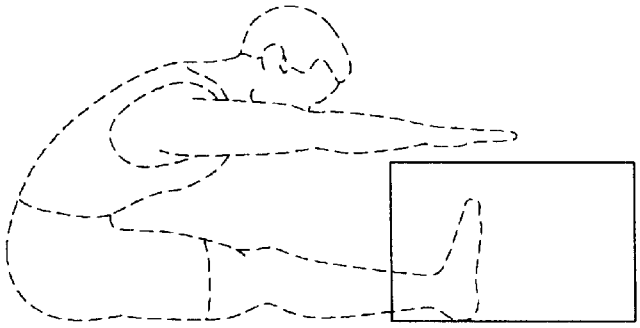
FIG. 2B (PRIOR ART)
FIG. 2*b* is a side view of the prior art at a second position.
Figure 2C:
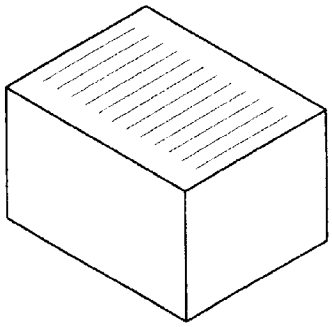
FIG. 2C (PRIOR ART)
FIG. 2*c* is a perspective view of the prior art.
Figure 3:
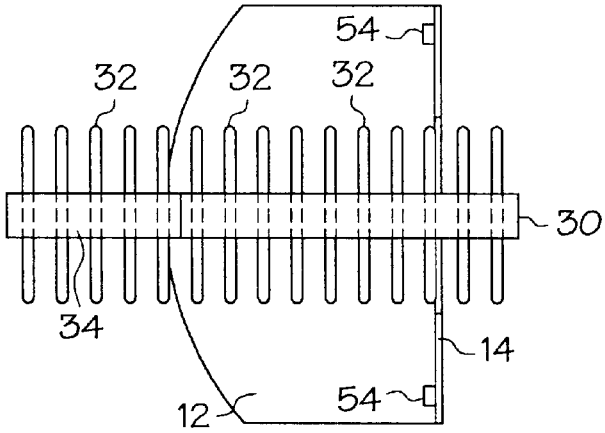
FIG. 3 is a top view of the invention.
Figure 4:
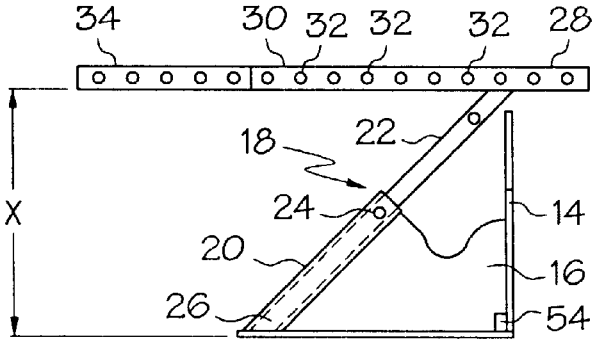
FIG. 4 is a side view of the invention.
Figure 5:
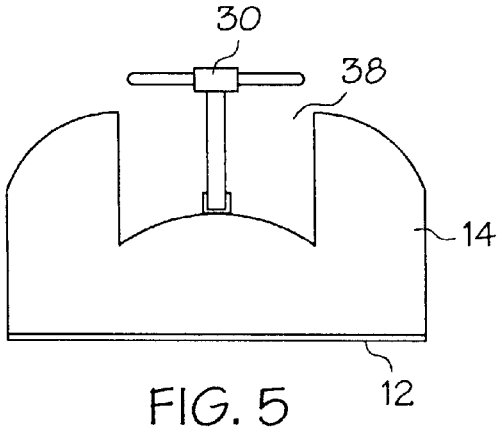
FIG. 5 is an end view of the invention.

Referring now to the drawings and more particularly FIGS. 1, and 3–6 a stretching machine 10 made according to the invention is depicted. A base plate 12 is adapted to support the machine 10 on the ground (not shown). A foot plate 14 is attached to the base plate 12. Any suitable method can be used to attach foot plate 14 to base plate 12, but in the preferred embodiment foot plate 14 is welded to the base plate 12. Foot plate 14 is arranged perpendicular to base plate 12.

A flange 16 is attached to the base plate 12 and the foot plate 14. The flange 16 is arranged perpendicular to both the base plate 12 and the foot plate 14 and provides stability to the machine 10. The flange 16 can be attached in any suitable manner but in the preferred embodiment the flange 16 is welded to the base plate 12 and the foot plate 14.

Attached to the flange 16 is a height adjustment member 18. The height adjustment member 18 comprises a bottom tube 20, a top tube 22 and a latch 24. The top tube 22 is telescopically received in the bottom tube 20. The top tube 22 and the bottom tube 20 have a square cross section in the preferred embodiment but could of course be any configuration including rectangular, circular or oval (not shown). A latch 24 fixes the top tube 22 with respect to the bottom tube 20. The latch 24 can be any suitable latching mechanism but in the preferred embodiment the latch is spring loaded. By pulling the latch 24 away from the height adjustment member 18 the top tube 22 is free to move. Releasing the latch 24 engages the latch once more fixing the tubes (20 and 22) with respect to each other. The height adjustment member 18 has an anchor 26 which is positioned on the base plate 12 opposite the foot plate 14. The height adjustment member 18 angles from the anchor 26 towards the foot plate 14.

A beam 30 is attached to the top tube 22 at end 28. The beam 30 is arranged parallel at a distance 'x' from the base plate 14. The distance 'x' is determined by the height adjustment member 18. Affixed to the beam 30 is a plurality of handgrips 32. The handgrips 32 are spaced apart from each other equal distances. The length of beam 30 is adjustable having a removable section 34 disposed at an end opposite the foot plate 14.

Foot plate 14 has a cut-out 38 on a side opposite the base plate 12. The cut-out 38 is wider than the handgrips 32. The cut-out 38 is configured such that as the height adjustment member 18 moves the beam 30 through the available range of distances 'x' the beam 30 passes through the cut-out 38.

The cut-out 38 allows the beam 30 to extend past the foot plate 14 when the height adjustment member 18 is fully extended. When the machine 10 is ready to be put away the height adjustment member 18 is fully contracted and the beam 30 does not extend past the foot plate 14.

Figure 6:
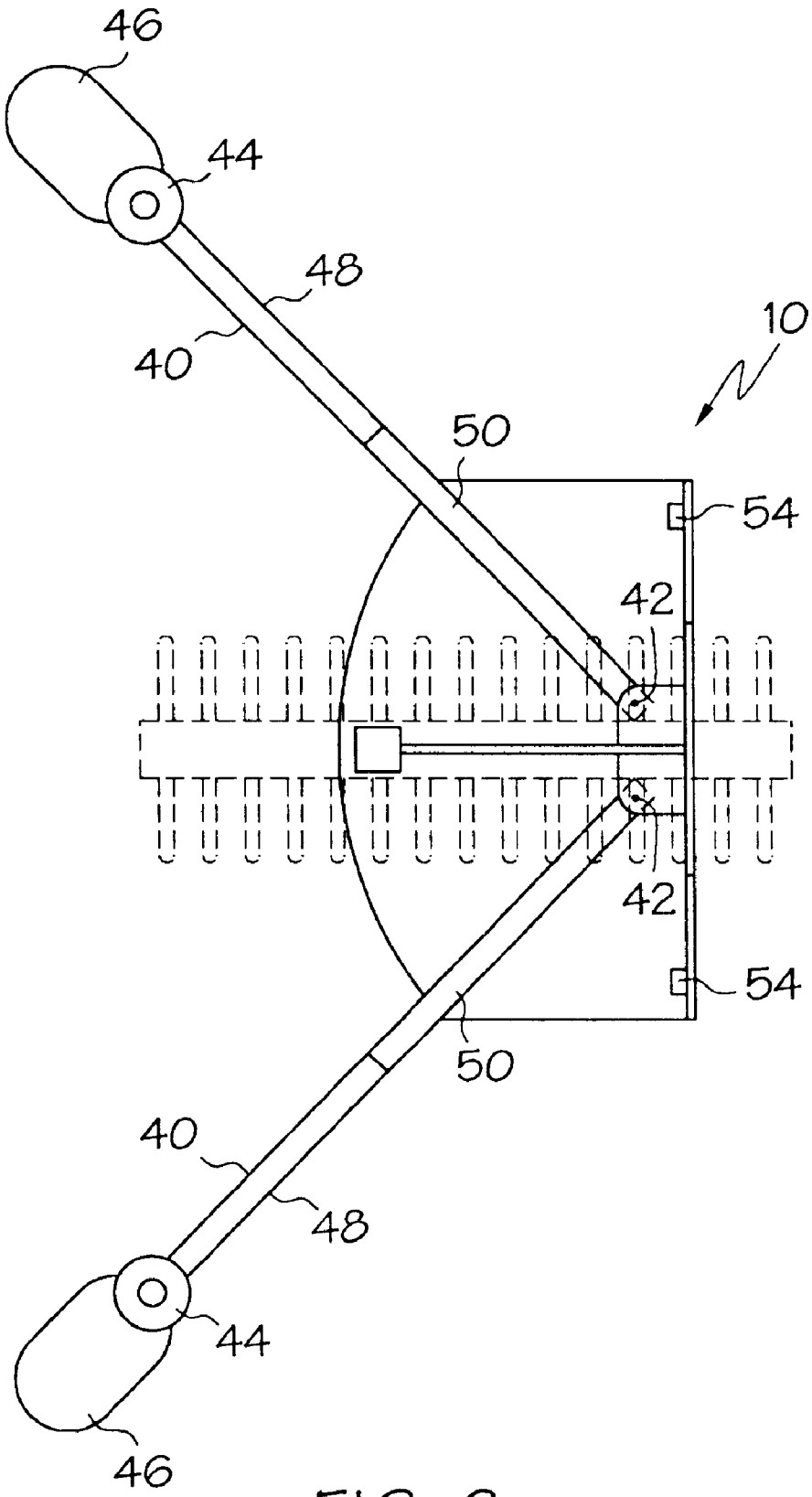
FIG. 6 is a top view of a second embodiment of the invention.

Turning now to FIG. 6 an additional feature of the machine can be seen. A pair of spread members 40 can be attachable to the machine 10 at pivot 42. Spread members 40 have a cushion 44 and a support 46 at an end opposite the pivot 42. The pivot 42 allows the spread members 40 to pivot between flange 16 and foot plate 14. Each spread member 40 is divided into a first section 48 and a second section 50. First section 48 and second section 50 are telescopically received within each other such that the length of spread member 40 is adjustable. The sections 48 and 50 are secured together by a pin (not shown in drawings) but could also be secured by any conventional means. Stops 54 on the end plate prevent the pair of spread members 40 from extending past a 180° arc.

In use the machine 10 is placed in a convenient spot on the floor. A user adjusts the beam 30 by releasing latch 24 and extending the height adjustment member 18. The user's feet are then placed against the foot plate 14 with the legs flat against the base plate 12 under the beam 30. The latch 24 is then released and the beam 30 is lowered to a desired location above the legs and allowing the latch 24 to engage. The user then leans forward and grasps a pair of the handgrips 32. The user can deepen the stretch by pulling the torso towards the beam. By noting which pair of handgrips 32 are grasped the user can determine a degree of flexibility. For a user with a high degree of flexibility the beam 30 can become an obstruction to an effective stretch. In such a case removable section 34 is removed from the beam 30.

The machine 10 is used with the spread members 40 in much the same way as described above. Instead of placing the feet against the foot plate 14, a user places the feet on 5 support 46 against cushion 44. The handgrips 32 are grasped and the user stretches a different set of muscles. The degree of the stretch can be varied by extending the spread members 40 towards the stops 54.

In view of the foregoing, it will be seen that the several advantages of the invention are achieved and attained. The preferred embodiment and alternatives were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. For example, the foot plate 14 could be welded to the base plate 12. Thus, the breadth and scope of the present invention should not be limited by any of the above-described exemplary embodiments, but should be defined only in accordance with the following claims appended hereto and their equivalents.

Having thus described my invention, what I claim as new and desire to secure by Letters Patent is as follows:

1. A stretching machine comprising:

a base plate adapted to lay flat on a floor to support the stretching machine;

a foot plate arranged perpendicular to said base plate;

a flange attached to said base plate and said foot plate and arranged perpendicular to said base plate and said foot plate;

a height adjustment member attached to said flange and having a bottom tube, a top tube, and a spring loaded latch, said top tube being telescopically received within said bottom tube, said spring loaded latch preventing movement of said top tube with respect to said bottom tube;

a beam attached to said top tube of said height adjustment member and arranged parallel to said base plate at a distance determined by said height adjustment member; and a plurality of handgrips attached to said beam and being evenly spaced.

2. The stretching machine of claim 1 wherein said beam further comprises a removable section.

3. The stretching machine of claim 1 wherein said foot plate further comprises a cut-out portion configured to allow said beam and said handgrips to be lowered towards said base plate.

4. The stretching machine of claim 1, wherein the machine is made of aluminum.

5. The stretching machine of claim 1 wherein said handgrips comprise a cross-bar.

6. The stretching machine of claim 1 further comprising a pair of spread members attached to said base plate such that said spread members can pivot between said flange and said foot plate.

7. The stretching machine of claim 6 wherein said spread members further comprises a first section and a second section telescopically received within each other such that the length of said spread member is adjustable.

8. A stretching machine to stretch a user's legs, the machine comprising:

a base plate adapted to support the machine;

a foot plate extending up from the base plate, the foot plate adapted to abut a foot of the user when the machine is in use;

a flange extending between the base plate and the foot plate, the flange adapted to provide stability to the machine;

a height adjustment member having a bottom tube, a top tube, and a latch, the bottom tube extending up from the base plate, the top tube telescopically engaging the bottom tube, the latch adapted to prevent movement of the top tube with respect to the bottom tube;

a beam having a plurality of handgrips extending away from the beam, the beam being operatively connected to the top tube of the height adjustment member, the beam arranged a distance above the base plate, the distance above the base plate being fixed by the latch of the height adjustment member; and wherein the machine being adapted to indicate a degree of flexibility of the user, the degree of flexibility being related to one of the plurality of handgrips that the user can reach when a foot of the user is adjacent the footplate and the user's legs are straight.

9. The stretching machine of claim 8, wherein the foot plate further comprises a cut-out portion, the cut-out portion being adapted to allow the beam to be lowered towards the base plate.

10. The stretching machine of claim 8 further comprising a pair of spread members, the spread members being operatively connected to the base plate such that the spread members can pivot.

11. The stretching machine of claim 10 wherein each of the spread members further comprises a first section and a second section, the first section telescopically engaging the second section such that a length of each of the spread members is adjustable.

12. A method comprising:

providing a stretching machine to stretch a user's legs, the machine comprising a base plate adapted to support the machine on a floor; a foot plate extending up from the base plate, the foot plate adapted to abut a foot of the user when the machine is in use; a flange extending between the base plate and the foot plate, the flange adapted to provide stability to the machine; a height adjustment member having a bottom tube, a top tube, and a spring loaded latch, the bottom tube extending up from the base plate, the top tube telescopically engaging the bottom tube, the latch adapted to prevent movement of the top tube with respect to the bottom tube; a beam having a plurality of handgrips extending away from the beam, the beam being operatively connected to the top tube of the height adjustment member, the beam arranged a distance above the base plate, the distance above the base plate being fixed by the latch of the height adjustment member; and wherein the machine being adapted to indicate a degree of flexibility of the user, the degree of flexibility being related to one of the plurality of handgrips that the user can reach when a foot of the user is adjacent the footplate and the user's legs are straight; and stretching a user's legs using the stretching machine.

13. A method as set forth in claim 12 further comprising:

measuring a degree of flexibility of the user.

14. A method as set forth in claim 13 wherein the measuring step further comprises determining which of the plurality of handgrips the user can reach when the user's legs are straight and the user's foot is adjacent the base plate.

* * * * *